US011800958B2

(12) United States Patent
Henne et al.

(10) Patent No.: US 11,800,958 B2
(45) Date of Patent: Oct. 31, 2023

(54) TOILET SEAT HINGE

(71) Applicant: Bemis Manufacturing Company, Sheboygan Falls, WI (US)

(72) Inventors: Brian A. Henne, Elkhart Lake, WI (US); Jonathan Arndt, Sheboygan, WI (US)

(73) Assignee: Bemis Manufacturing Company, Sheboygan Falls, WI (US)

( * ) Notice: Subject to any disclaimer, the term of this patent is extended or adjusted under 35 U.S.C. 154(b) by 0 days.

(21) Appl. No.: 17/679,624

(22) Filed: Feb. 24, 2022

(65) Prior Publication Data

US 2022/0265099 A1 Aug. 25, 2022

Related U.S. Application Data

(60) Provisional application No. 63/153,106, filed on Feb. 24, 2021.

(51) Int. Cl.
*A47K 13/12* (2006.01)

(52) U.S. Cl.
CPC ..... *A47K 13/12* (2013.01)

(58) Field of Classification Search
CPC ..... A47K 13/12
USPC ..... 4/236
See application file for complete search history.

(56) References Cited

U.S. PATENT DOCUMENTS

| | | | | |
|---|---|---|---|---|
| 4,729,134 | A | 3/1988 | Hillebrand et al. | |
| 5,193,228 | A | 3/1993 | Murasawa et al. | |
| 5,933,875 | A | 8/1999 | Hulsebus et al. | |
| 6,070,295 | A | 6/2000 | Hulsebus | |
| 6,243,884 | B1 | 6/2001 | Simonson | |
| 6,381,762 | B1 * | 5/2002 | Moser | A47K 13/12 4/240 |
| 7,203,975 | B2 | 4/2007 | Vierkant, III | |
| 7,389,549 | B2 | 6/2008 | Vierkant, III | |
| 8,122,523 | B2 | 2/2012 | Li | |
| 8,205,274 | B2 | 6/2012 | Lin et al. | |
| 8,214,931 | B2 | 7/2012 | Bemis et al. | |
| 8,214,932 | B2 | 7/2012 | Shannon | |
| 8,763,168 | B2 | 7/2014 | Zhou | |

(Continued)

FOREIGN PATENT DOCUMENTS

| | | | |
|---|---|---|---|
| EP | 2189092 | A1 | 5/2010 |
| FR | 2297026 | A1 | 8/1976 |
| WO | 2008136914 | A2 | 11/2008 |

OTHER PUBLICATIONS

Kohler, "Kohler Replacement Hinge Assembly," <https://www.build.com/product/summary/57530?uid=1845618&jmtest=gg-gbav2_1845618&inv2=1&&source=gg-gba-pla_1845618!c6970301186!a77305318222!dc!hg&gclid=EAlalQobChMlrLDF37L19QIVshbUAR3S6wDkEAkYCSABEgLPYvD_BwE&gclsrc=aw.ds> web page visited Feb. 10, 2022.

(Continued)

*Primary Examiner* — Christine J Skubinna
(74) *Attorney, Agent, or Firm* — Michael Best & Friedrich LLP

(57) ABSTRACT

The present disclosure provides a toilet seat hinge configured to couple a toilet seat to a toilet bowl. The toilet seat hinge including a base configured to be coupled to an upper surface of the toilet bowl, a post defining a pivot axis about which the toilet seat can rotate, the post being slidable onto the base in a direction parallel to the upper surface of the toilet bowl to couple the post to the base, and a cap pivotally coupled to the post. The cap being pivotable about the pivot axis to secure the post on the base.

18 Claims, 7 Drawing Sheets

(56) References Cited

U.S. PATENT DOCUMENTS

| | | | | |
|---|---|---|---|---|
| 8,943,618 | B2 | 2/2015 | Dundas et al. | |
| 9,635,987 | B2 | 5/2017 | Hand et al. | |
| 9,976,293 | B2 | 5/2018 | Bickerstaffe et al. | |
| 9,986,878 | B2 | 6/2018 | Stelter et al. | |
| 10,064,524 | B2 | 9/2018 | Eilmus et al. | |
| 10,106,969 | B2 | 10/2018 | Halloran et al. | |
| 10,125,894 | B2 | 11/2018 | Ji et al. | |
| 10,194,777 | B2 | 2/2019 | Laundre | |
| 10,299,639 | B2 | 5/2019 | Stevenson et al. | |
| 10,337,223 | B2 | 7/2019 | Murphy | |
| 10,352,031 | B2 | 7/2019 | Muellenbach | |
| 10,414,540 | B2 | 9/2019 | Meicher et al. | |
| 10,448,762 | B2 | 10/2019 | Murphy et al. | |
| 10,450,733 | B2 | 10/2019 | Luettgen et al. | |
| 10,463,209 | B1 | 11/2019 | Laundre | |
| 10,487,490 | B2 | 11/2019 | Laundre et al. | |
| 10,544,574 | B2 | 1/2020 | Kuru et al. | |
| 10,575,685 | B2 | 3/2020 | Szemetylo et al. | |
| 10,582,817 | B2 | 3/2020 | Laundre | |
| 10,610,068 | B2 | 4/2020 | Laundre et al. | |
| 10,610,069 | B2 | 4/2020 | Laundre | |
| 10,663,938 | B2 | 5/2020 | Rexach et al. | |
| 10,738,448 | B2 | 8/2020 | Swart et al. | |
| 10,745,898 | B2 | 8/2020 | Halloran et al. | |
| 10,851,532 | B2 | 12/2020 | Denzin et al. | |
| 10,887,125 | B2 | 1/2021 | Rexach et al. | |
| 10,912,431 | B2 | 2/2021 | Grin et al. | |
| 2006/0156458 | A1 | 7/2006 | Myers | |
| 2006/0218710 | A1* | 10/2006 | Furukawa | A47K 13/305 4/237 |
| 2007/0017013 | A1 | 1/2007 | Pronovost | |
| 2007/0250996 | A1 | 11/2007 | Li | |
| 2010/0223718 | A1 | 9/2010 | Andersen | |
| 2016/0037982 | A1* | 2/2016 | Zhou | A47K 13/26 4/240 |
| 2017/0058500 | A1 | 3/2017 | Garrels et al. | |
| 2019/0045984 | A1 | 2/2019 | Murphy | |
| 2019/0086890 | A1 | 3/2019 | Bradley et al. | |
| 2019/0087510 | A1 | 3/2019 | Rexach et al. | |
| 2019/0120809 | A1 | 4/2019 | Rexach et al. | |
| 2019/0146438 | A1 | 5/2019 | Rexach et al. | |
| 2019/0257065 | A1 | 8/2019 | Schibur et al. | |
| 2019/0313863 | A1 | 10/2019 | Laundre | |
| 2019/0323222 | A1 | 10/2019 | Muellenbach | |
| 2019/0373152 | A1 | 12/2019 | Tan et al. | |
| 2020/0002930 | A1 | 1/2020 | Uettgen et al. | |
| 2020/0107681 | A1 | 4/2020 | Laundre | |
| 2020/0157792 | A1 | 5/2020 | Kuru et al. | |
| 2020/0187723 | A1 | 6/2020 | Szemetylo et al. | |
| 2020/0224399 | A1 | 7/2020 | Garrels et al. | |
| 2020/0253432 | A1 | 8/2020 | Slothower et al. | |
| 2020/0407962 | A1 | 12/2020 | Luettgen et al. | |
| 2021/0054608 | A1 | 2/2021 | Denzin et al. | |
| 2021/0106191 | A1 | 4/2021 | Chung et al. | |
| 2021/0378464 | A1 | 12/2021 | Laundre | |

OTHER PUBLICATIONS

Kohler, "K-1109093-0 Hinge Assembly," <https://www.us.kohler.com/us//productDetail/servicepasrt:621237/621237.htm> web page visited Feb. 10, 2022.

European Extended Search Report for Application No. 22158320.6 dated Jul. 25, 2022 (7 pages).

* cited by examiner

TOILET SEAT HINGE

CROSS-REFERENCE TO RELATED APPLICATIONS

This application claims the benefit of co-pending U.S. Provisional Patent Application No. 63/153,106, filed Feb. 24, 2021, the entire contents of which are incorporated by reference herein.

FIELD OF THE DISCLOSURE

The present disclosure relates to a platform-style toilet seat hinge.

SUMMARY

In one embodiment, the present disclosure provides a toilet seat hinge configured to couple a toilet seat to a toilet bowl. The toilet seat hinge including a base configured to be coupled to an upper surface of the toilet bowl, a post defining a pivot axis about which the toilet seat can rotate, the post being slidable onto the base in a direction parallel to the upper surface of the toilet bowl to couple the post to the base, and a cap pivotally coupled to the post. The cap being pivotable about the pivot axis to secure the post on the base.

In another embodiment, the present disclosure provides a platform-style toilet seat hinge configured to couple a toilet seat to a toilet bowl. The platform-style hinge including a unitary base having a first end and a second end opposite the first end. The unitary base defining a first through hole proximate the first end and a second through hole proximate the second end. The unitary base configured to be positioned on an upper surface of the toilet bowl. The platform-style toilet seat hinge further including a first fastener extending through the first through hole to couple the unitary base to the toilet bowl, a second fastener extending through the second through hole to couple the unitary base to the toilet bowl, and a post including an upright portion and a frame extending from the upright portion. The upright portion defining a pivot axis about which the toilet seat can rotate. The frame being slidable onto the unitary base in a direction parallel to the upper surface of the toilet bowl to couple the post to the unitary base.

In yet another embodiment, the present disclosure provides a method of coupling a platform-style toilet seat hinge to a toilet bowl. The platform style toilet seat hinge including a unitary base and a post. The method including positioning the unitary base on an upper surface of the toilet bowl, the unitary base having a first end and a second end opposite the first end, the unitary base defining a first through hole proximate the first end and a second through hole proximate the second end, inserting a first fastener through the first through hole to couple the unitary base to the toilet bowl, inserting a second fastener through the second through hole to couple the unitary base to the toilet bowl, and sliding the post onto the unitary base in a direction parallel to the upper surface of the toilet bowl, the post defining a pivot axis about which a toilet seat can pivot.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Terms of degree, such as "substantially," "about," "approximately," etc. are understood by those of ordinary skill to refer to reasonable ranges outside of the given value, for example, general tolerances associated with manufacturing, assembly, and use of the described embodiments.

Figure 1:
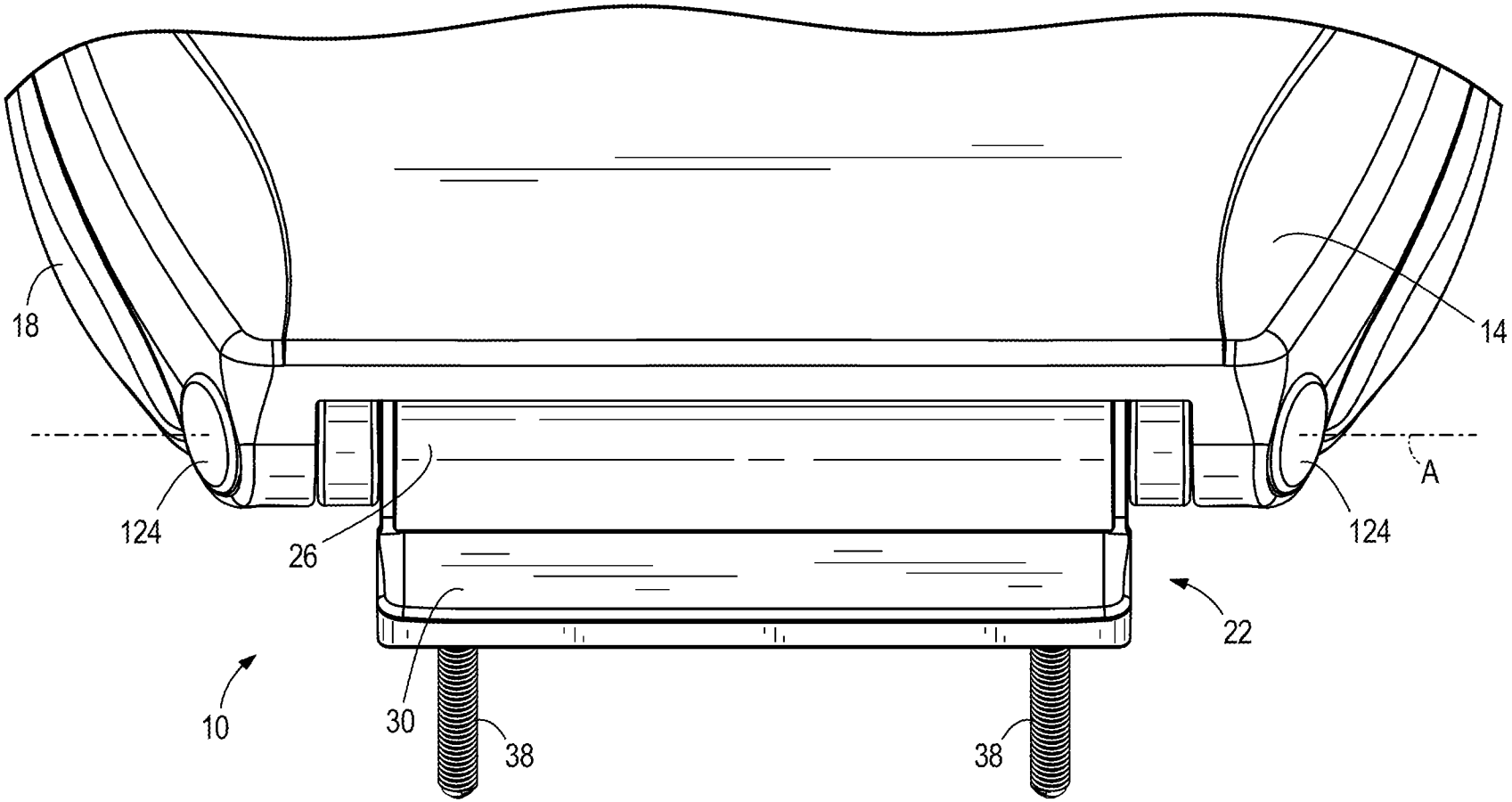
FIG. 1 is a top perspective view of a portion of a toilet seat assembly including a platform toilet seat hinge embodying the disclosure.
Figure 2:
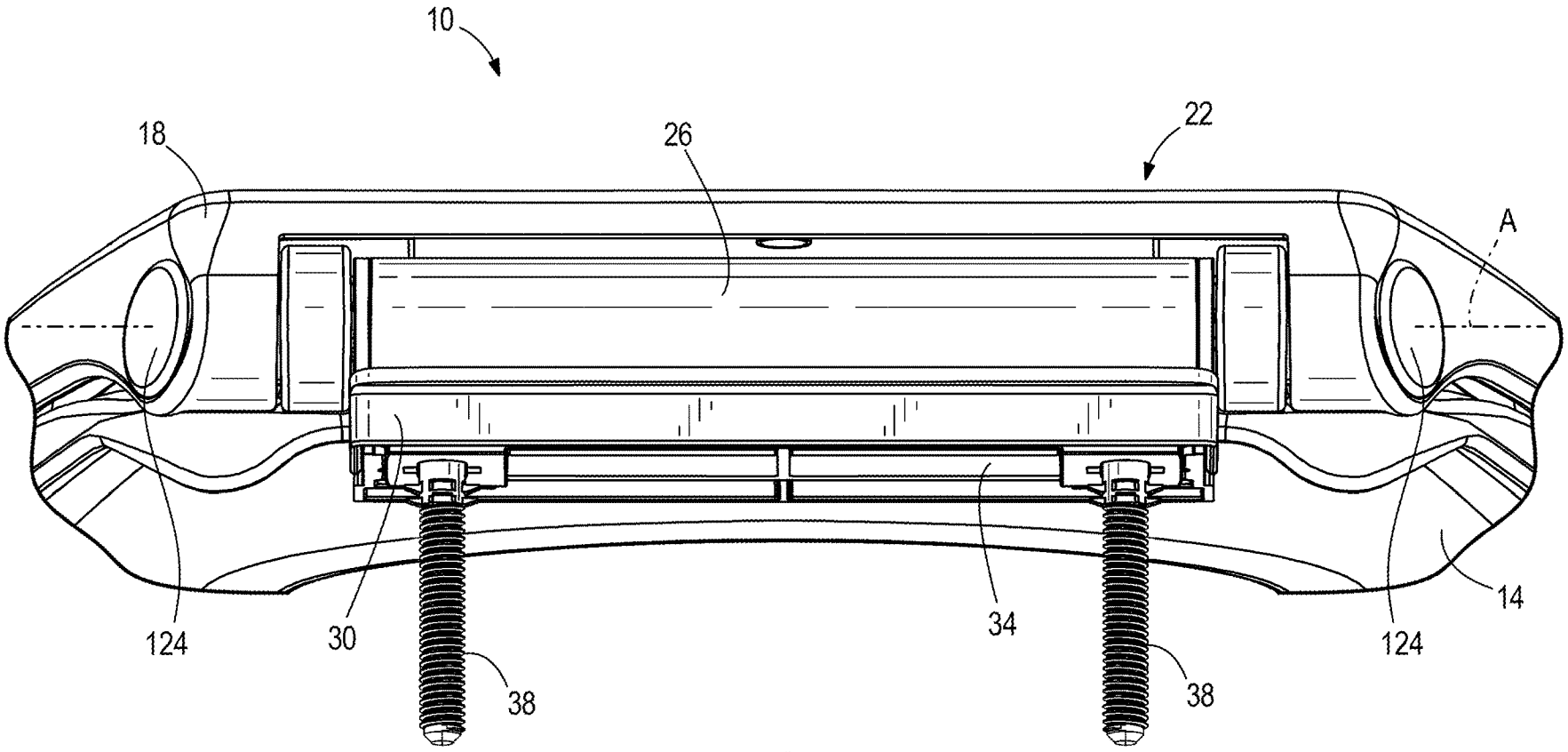
FIG. 2 is a bottom perspective view of the toilet seat assembly shown in FIG. 1.

FIGS. 1 and 2 illustrate a toilet seat assembly 10 that is mountable to a toilet bowl (not shown). The toilet seat assembly 10 includes a toilet cover lid 14, a toilet seat 18, and a toilet seat hinge 22. The hinge 22 pivotally couples the cover 14 and the seat 18 to the toilet bowl about a pivot axis A. In the illustrated embodiment, the hinge 22 is a platform-style hinge and is selectively fixed to the toilet bowl via two fasteners 38 that extend through the toilet bowl. In other embodiments, the hinge 22 can include two separate portions each selectively fixed to the toilet bowl by one fastener 38 or one mounting post (e.g., such a construction is disclosed within U.S. Pat. No. 9,986,878, the contents of which are incorporated herein by reference). With continued reference to FIGS. 1 and 2, the illustrated toilet seat hinge 22 includes a post 26, a quick-disconnect cap 30 (e.g., a locking member) pivotally coupled to the post 26, and a base 34 selectively coupled to the post 26 and the cap 30 as discussed in more detail below.

Figure 3:
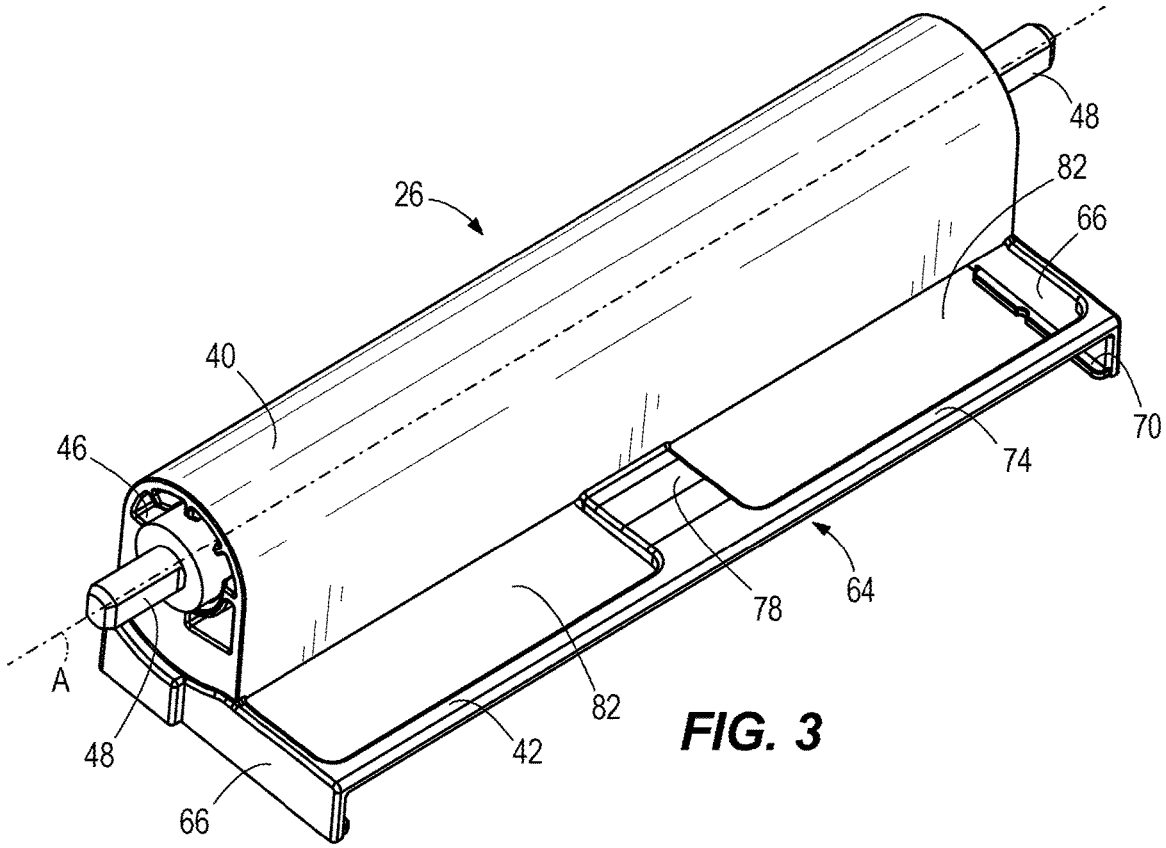
FIG. 3 is a top perspective view of a post of the platform toilet seat hinge shown in FIG. 1.
Figure 4:
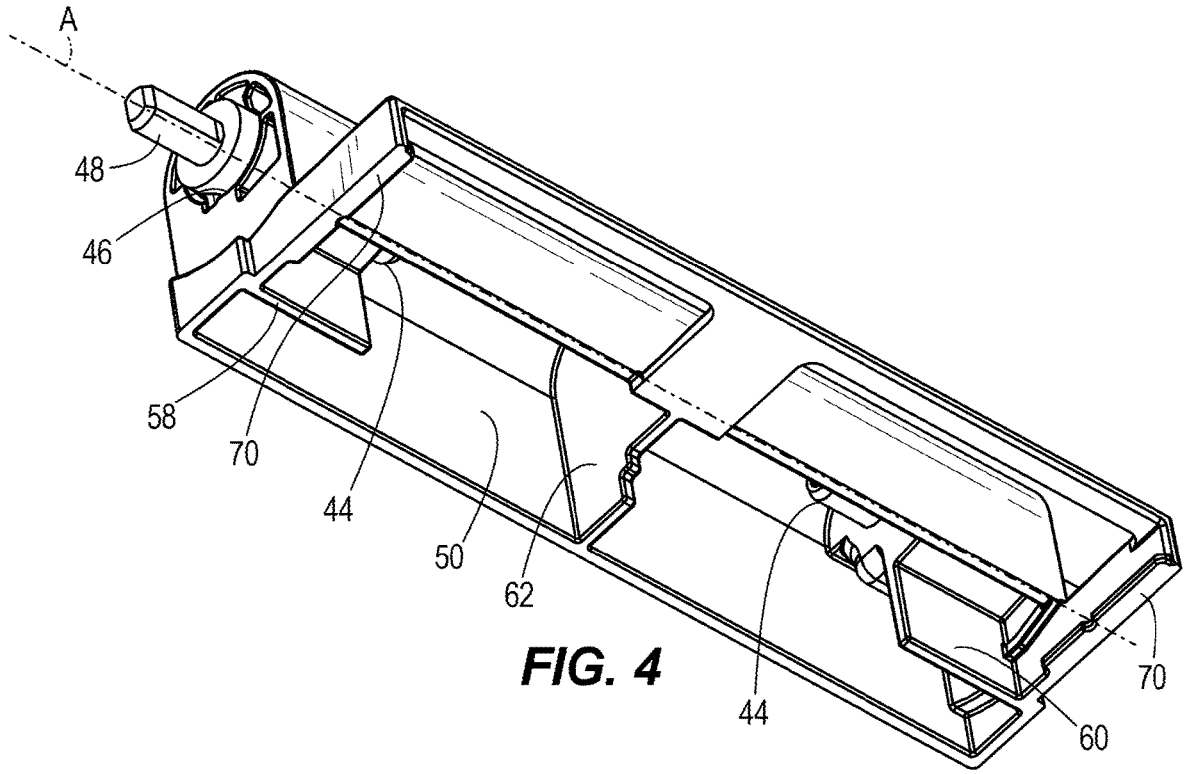
FIG. 4 is a bottom perspective view of the post shown in FIG. 3.

As shown in FIGS. 3 and 4, the illustrated post 26 includes an upright portion 40 and a frame 42 extending from the upright portion 40. The upright portion 40 is generally perpendicular to the frame 42 (e.g., the upright portion 40 extends away from an upper surface of the toilet bowl) and extends in a longitudinal direction that is parallel to the pivot axis A. The upright portion 40 includes sleeves 44 on each end of the post 26, and each of the sleeves 44 includes an opening 46. The two openings 46 are concentric to define the pivot axis A. In the illustrated embodiment, slow close dampers 48 are received within the sleeves 44. The slow close dampers 48 are coupled to the toilet cover lid 14 and the toilet seat 18 to enable movement of the lid 14 and the seat 18 relative to the post 26. In other embodiments, the sleeves 44 may receive other members (e.g., fixed pins, etc.) to support the lid 14 and the seat 18 relative to the post 26.

With continued reference to FIGS. 3 and 4, the upright portion 40 is substantially hollow to define a cavity 50 in which the sleeves 44 are arranged. In other embodiments, the upright portion 40 can be a substantially solid member. As shown in FIG. 4, the post 26 further includes supports 58, 60, 62 (e.g., legs) disposed within the cavity 50. The first and second legs 58, 60 support the sleeves 44 relative to the toilet bowl, and the third leg 62 supports a mid-section of the upright portion 40 relative to the toilet bowl as discussed in more detail below.

As also shown in FIGS. 3 and 4, the frame 42 includes side members 66 which project from each end of the upright portion 40, a cross member 74 connecting the side members 66, and a central member 78 connecting a portion (e.g., a center portion) of the cross member 74 to a portion (e.g., a center portion) of the upright portion 40. The side members 66 and the cross member 74 define an opening of a slot 64 that extends from a rear end of the frame 42 to the legs 58, 60, 62 of the upright portion 40 in a direction perpendicular to the pivot axis A. In addition, each side member 66 includes a rail 70 extending toward each other into the slot 64 (e.g., extending in a direction parallel to the pivot axis A). Also, the cross member 74, the side members 66, the central member 78, and a rear portion of the upright portion 40 define two openings 82 to provide top access to the slot 64. In other embodiments, the openings 82 can be omitted such that the central member 78 extends between the side members 66 forming a continuous upper wall of the slot 64.

Figure 5:
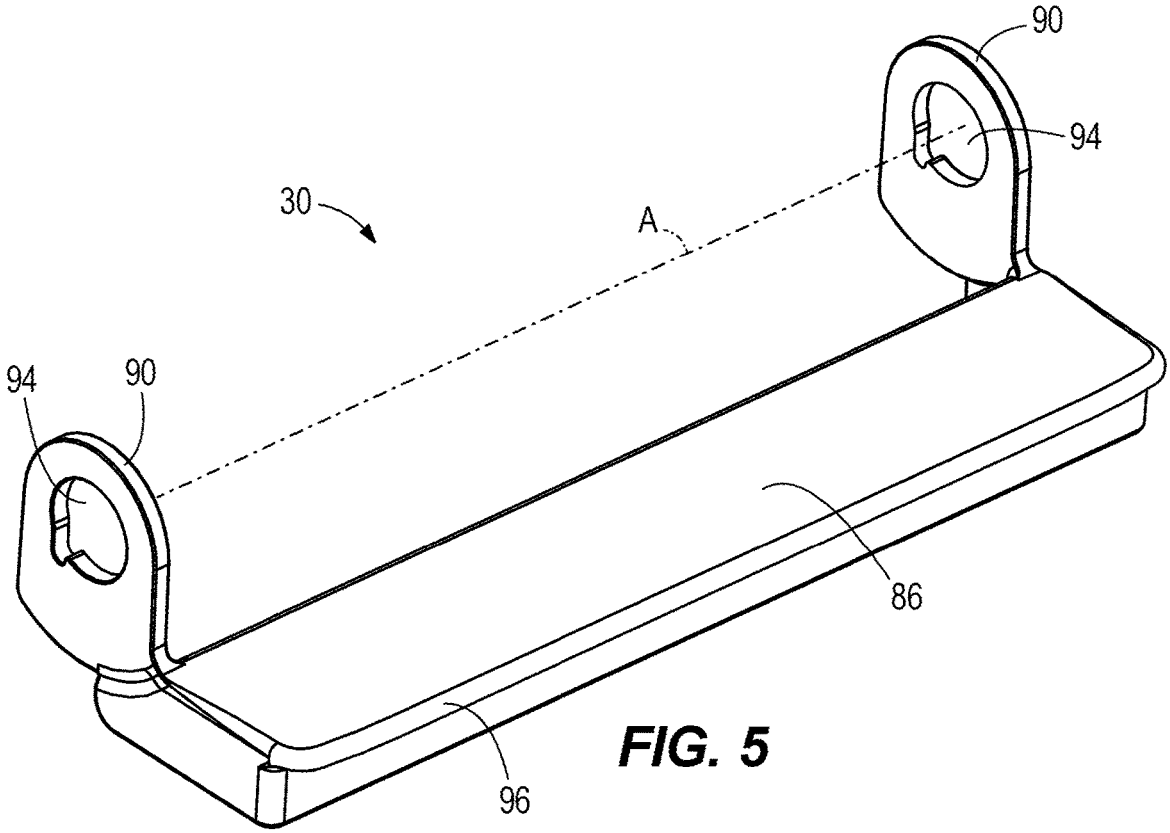
FIG. 5 is a top perspective view of a quick-disconnect cap of the platform toilet seat hinge shown in FIG. 1.
Figure 6:
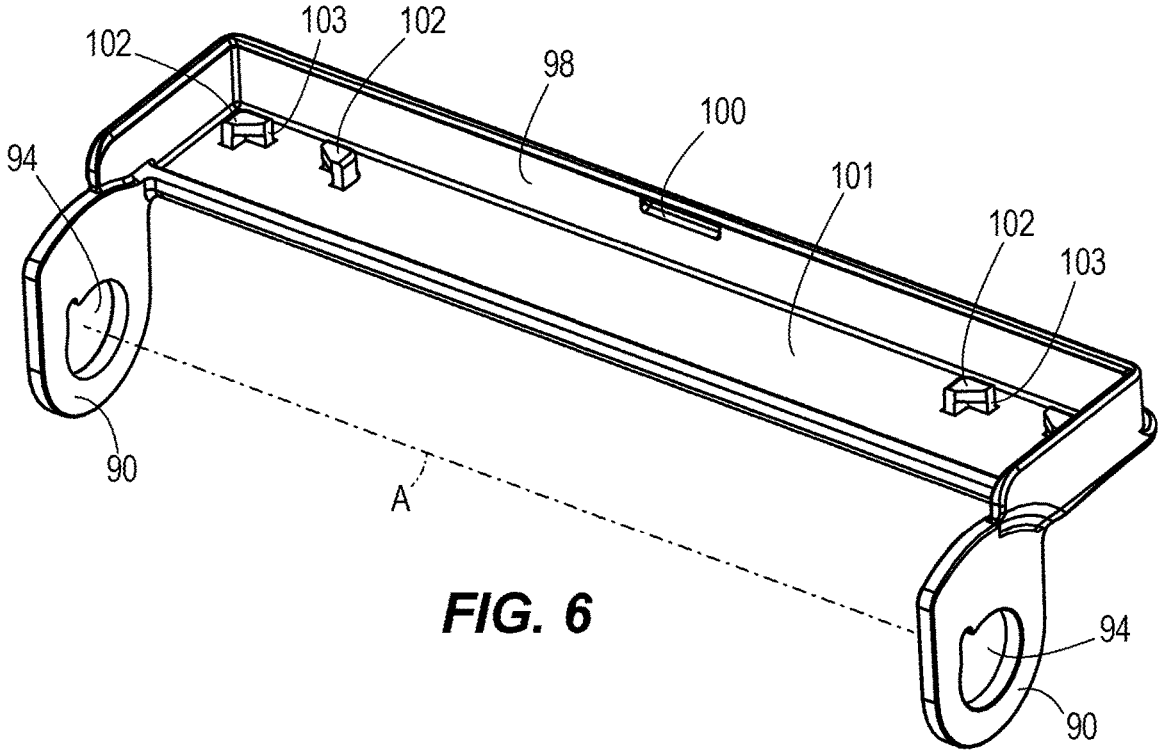
FIG. 6 is a bottom perspective view of the quick-disconnect cap shown in FIG. 5.

As shown in FIGS. 5 and 6, the illustrated cap 30 includes a cover 86 and pivot portions 90 (e.g., arms) extending from the cover 86. The pivot portions 90 are pivotally coupled to the upright portion 40 (e.g., via the soft close dampers 48), enabling the cap 30 to be pivotally coupled to the post 26 about the pivot axis A. Each pivot portion 90 includes an opening 94 that aligns with an opening 46 of the upright portion 40. As best shown in FIG. 5, the cover 86 includes a grip portion 96 (e.g., an actuator) that protrudes from a top surface of the cover 86 and is engageable by a user to pivot the cap 30 about the pivot axis A. In the illustrated embodiment, the grip portion 96 is a lip. In other embodiments, the grip portion 96 may include other suitable structures that may be engaged by a user, such as one or more vertical or side projections, one or more recesses, and the like.

With reference to FIG. 6, the cover 86 further includes a wall 98 extending around three sides of the cover 86. In other embodiments, the wall 98 can extend from one side of the cover 86 (e.g., underneath the grip portion 96). The illustrated wall 98 includes a recess 100 formed in an interior surface of the wall 98. The cover 86 further includes a bottom surface 101 including protrusions 102 spaced from the interior surface of the wall 98 such that a gap 103 is positioned between each protrusion 102 and the wall 98 including the recess 100. Each illustrated protrusion 102 has an L-shaped cross-section at an end adjacent the bottom surface 101 and a triangular cross-section at a free end of the protrusion 102. In the illustrated embodiment, the cover 86 includes two pairs of protrusions 102. In other embodiments, the cover 86 can include fewer or more than two pairs of protrusions 102 (e.g., each pair can form a single protrusion, a single protrusion can extend in a direction parallel to the pivot axis A, etc.).

Figure 7:
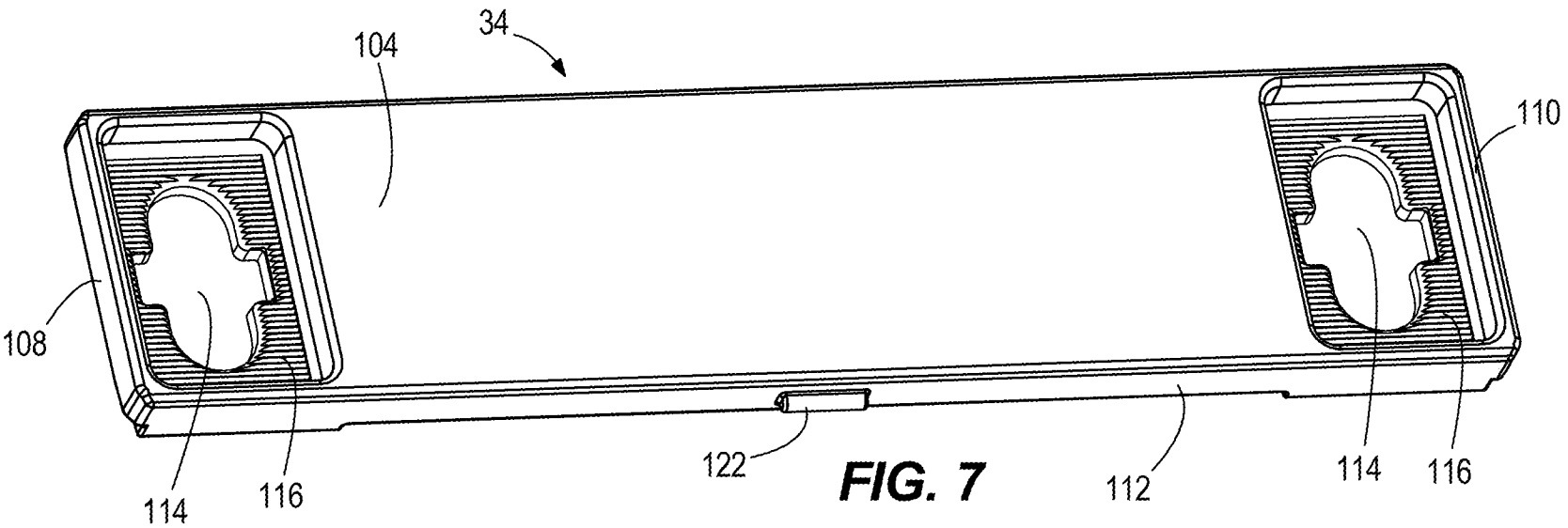
FIG. 7 is a top perspective view of a base of the platform toilet seat hinge shown in FIG. 1.
Figure 8:
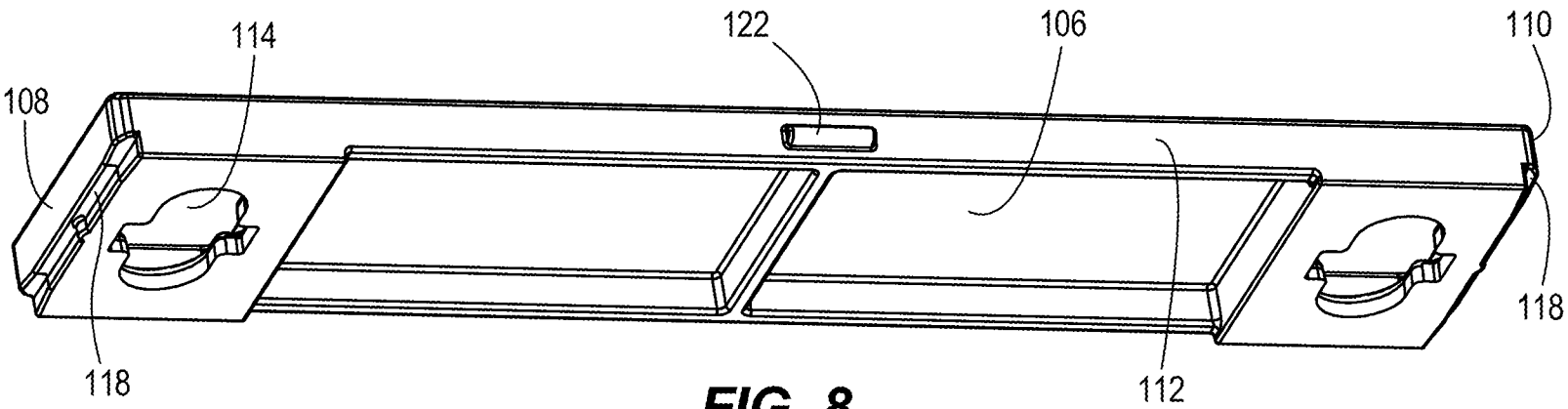
FIG. 8 is a bottom perspective view of the base shown in FIG. 7.

As shown in FIGS. 7 and 8, the base 34 includes a top side 104 and a bottom side 106 opposite the top side 104. The top side 104 and the bottom side 106 each terminate at a first end 108 and a second end 110 opposite the first end 108. A rear edge 112 extends between the top side 104 and the bottom side 106 and between the first end 108 and the second end 110. In the illustrated embodiment, the base 34 is a unitary base that presents itself as one piece. For example, the base 34 may be made of a single piece of plastic. Alternatively, the base 34 may be made of multiple pieces that are permanently secured together by welding, gluing, fastening, molding, and the like. The bottom side 106 of the base 34 abuts the toilet bowl when the base 34 is affixed to the toilet bowl by the fasteners 38. In particular, two recesses 116 are formed on the top side 104 of the base 34 adjacent the first end 108 and the second end 110, respectively. The base 34 also includes elongated through holes 114, each extending through one of the recesses 116. Each through hole 114 is sized to receive a shaft and a resilient bushing of a fastener 38, and each recess 116 is sized to receive a head of a fastener 38. Moreover, the recesses 116 include a bottom contoured surface (e.g., jagged surface) that engages with a lower contoured surface (e.g., jagged surface) of the heads of the fasteners 38 to hold a position of the fasteners 38 within the elongated through holes 114. With reference to FIG. 8, the bottom side 106 includes two slots 118 with one of the slots 118 adjacent the first end 108 and another one of the slots 118 adjacent the second end 110. The base 34 further includes a projection 122 extending from the rear edge 112.

To assemble the toilet seat assembly 10, the post 26, the cap 30, the toilet seat 18, and the toilet lid 14 are aligned along the pivot axis A to be coupled together by the slow close dampers 48. In particular, the openings 94 of the cap 30 are aligned with the openings 46 of the post 26. The toilet cover lid 14 and the toilet seat 18 are then aligned with the openings 46, 94. The slow close dampers 48 are inserted into the sleeves 44 of the post 26 through pivot rings of the toilet seat 18, pivot rings of the toilet lid 14, and the pivot portions 90 of the cap 30. Inserts 124 (FIGS. 1 and 2) are then inserted into sides of the lid 14 to engage the pivot rings of the lid 14 and the pivot rings of the seat 18. The inserts 124 fix the lid 14 and the seat 18 to outboard portions of the slow close dampers 48, whereas inboard portions of the slow close dampers 48 are fixed within the sleeves 44. Accordingly, the slow close dampers 48 control movement of the lid 14 and/or the seat 18 relative to the post 26 about the pivot axis A. In addition, the cap 30 is freely pivotable about the pivot axis A.

Figure 9:
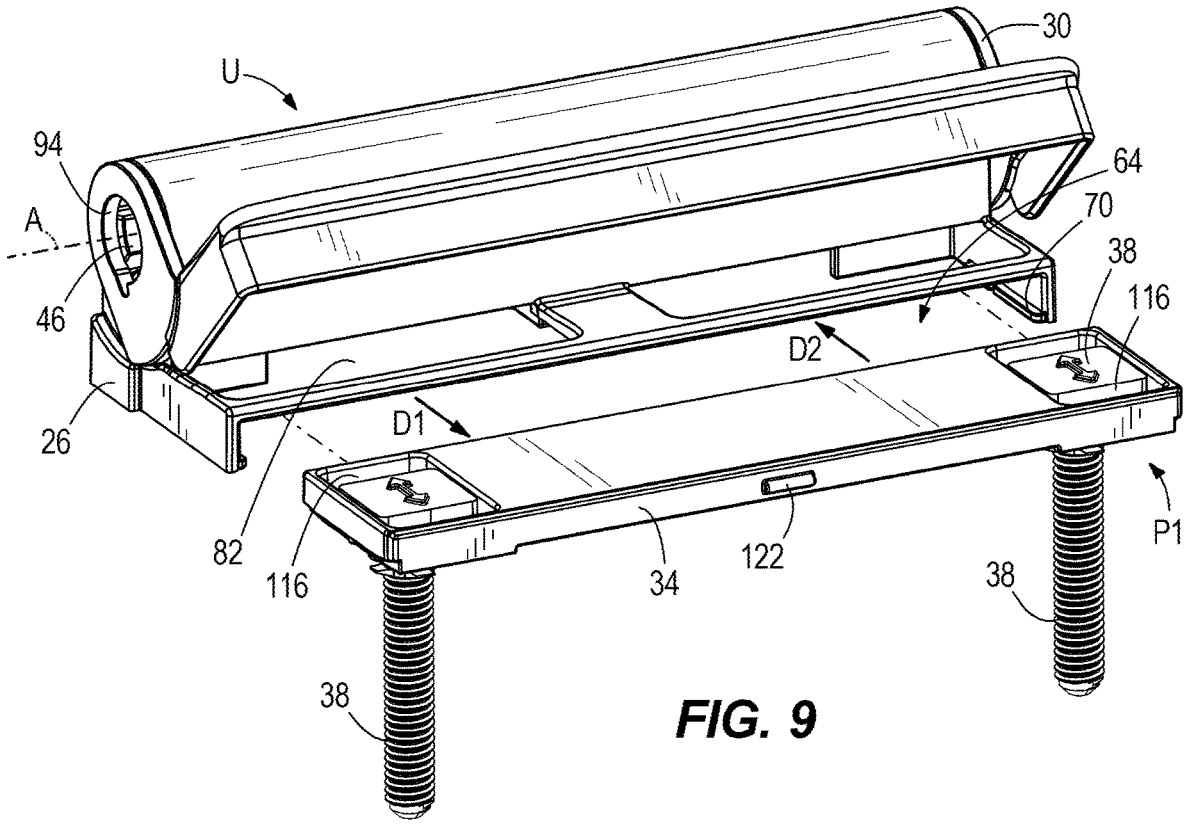
FIG. 9 is a perspective view of the platform toilet seat hinge shown in FIG. 1 illustrating the quick-disconnect cap and the post spaced from the base in an uninstalled position.
Figure 10:
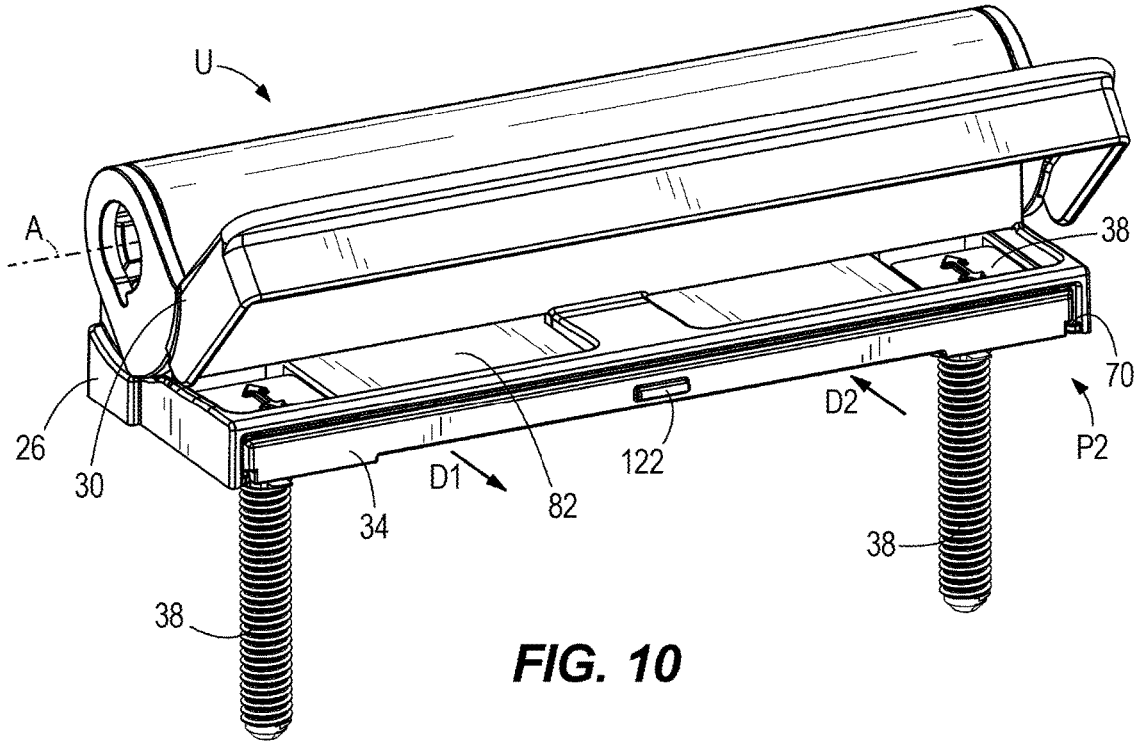
FIG. 10 is a perspective view of the platform toilet seat hinge shown in FIG. 1 illustrating the quick-disconnect cap and the post coupled to the base in an unlocked position.
Figure 11:
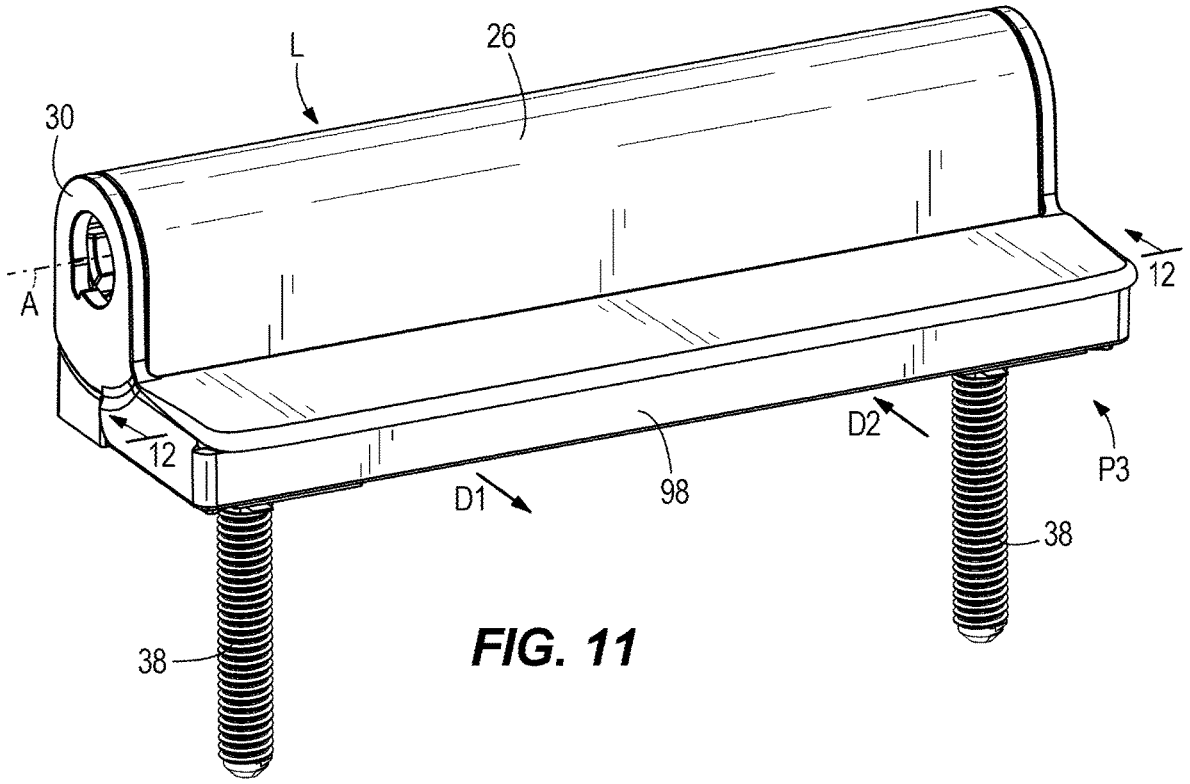
FIG. 11 is a perspective view of the platform toilet seat hinge shown in FIG. 1 illustrating the quick-disconnect cap and the post coupled to the base in a locked position.

FIGS. 9-11 illustrate assembly of the toilet seat assembly 10 to the toilet bowl. Although the disclosure of assembling the toilet seat assembly 10 to the toilet bowl is discussed in specific steps below, not all of the steps need to be performed. In addition, the disclosed steps do not need to be performed in the disclosed order. Assembly of the toilet seat assembly 10 to the toilet bowl can also include additional or alternative steps.

As shown in FIG. 9, in an uninstalled position P1 of the toilet seat assembly 10, the lid 14, the seat 18, the cap 30, and the post 26 are separated from the base 34, and the base 34 is fixed to the toilet bowl by the fasteners 38. In particular, the fasteners 38 are inserted into the through holes 114 (FIGS. 7 and 8) so that fastening nuts are tightened onto the fasteners 38 to clamp the base 34 to the toilet bowl. Before the base 34 is fixed onto the toilet bowl, the base 34 can be adjusted relative to the toilet bowl as the recesses 116 provide clearance for the heads of the fasteners 38 to move within the recesses 116 (e.g., to adjust the base 34 in a forward direction or a rearward direction). Additionally, the heads of the fasteners 38 rest within the recesses 116 to be substantially flush with the top side 104 of the base 34. The illustrated heads of the fasteners 38 may not include any type of tightening mechanism (e.g., a slot that receives a screwdriver, a hexagonal protrusion to be engaged by a drive socket, etc.) such that the fastening nuts threaded onto the fasteners 38 are the tightening mechanisms to fix the base 34 to the toilet bowl.

The assembly of the lid 14, the seat 18, the post 26, and the cap 30 is then slid onto the base 34. In particular, the post 26 moves in a first direction D1 (parallel to the upper surface of the toilet bowl that supports the base 34) over the base 34 such that the slot 64 of the post 26 receives the base 34. As shown in FIG. 10, in an installed and unlocked position P2, the rails 70 of the post 26 and the slots 118 of the base 34 are in engagement to inhibit the post 26 from moving upwardly away from the upper surface of the toilet bowl. The post 26 is slid onto the base 34 until the base 34 contacts the legs 58, 60, 62 (e.g., engagement between the legs 58, 60, 62 and the base 34 limits an insertion depth of the base 34 within the slot 64). In some embodiments, the base 34 and the post 26 can include detent members to releasably hold the post 26 on the base 34 as shown in FIG. 10. In the installed and unlocked position P2, the cap 30 is in an unlocked position U that provides access to the fasteners 38 through the openings 82 of the post 26.

Figure 12:
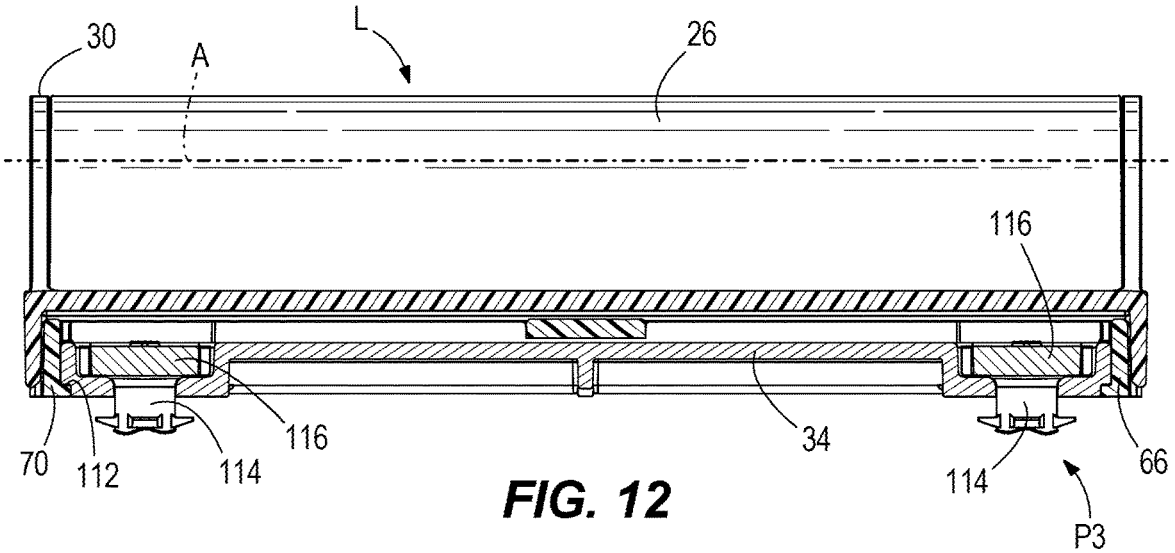
FIG. 12 is a cross-sectional view of the platform toilet seat hinge shown in FIG. 11 along line 12-12.

As shown in FIGS. 11 and 12, in an installed and locked position P3, the cap 30 is pivoted down about the pivot axis A toward the base 34 into a locked position L to secure the assembly of the toilet lid 14, the toilet seat 18, the cap 30, and the post 26 onto the base 34. In the locked position L, the wall 98 of the cap 30 covers the slot 64 of the post 26 such that the post 26 is inhibited from moving in a second direction D2 opposite the first direction D1 to separate from the base 34. The fasteners 38 are additionally covered by the cap 30 and are inaccessible in the locked position L of the cap 30. Also in the locked position L, the projection 122 of the base 34 is received within the recess 100 of the cap 30 to releasably hold the cap 30 in the locked position L. The projection 122 and the recess 100 together form a force-fit connection between the base 34 and the cap 30. The projection 122 engages the recess 100 so that a sufficient force on the cap 30 is required to disengage the cap 30 from the base 34 and move the cap 30 into the unlocked position U. The sufficient force may be obtained by a user pushing up on the grip portion 96 of the cap 30. In other embodiments, the cap 30 may include the projection 122, and the base 34 may include the recess 100. In further embodiments, other types of mechanisms can releasably hold the cap 30 to the base 34, such as a magnet or a friction fit-type interface. Additionally, in the installed and locked position P3, the cross member 74 of the post 26 is received within the gap 103 of the cap 30. In some embodiments, the cross member 74 engages the protrusions 102 and the wall 98 to assist the engagement between the projection 122 and the recess 100 in holding the cap 30 in the locked position L.

As discussed above, the legs 58, 60, 62 of the post 26 contact the toilet bowl to support the hinge 22 on the toilet bowl. Accordingly, during use of the toilet seat assembly 10, a user sits on the toilet seat 18 when in the in-use position and at least the legs 58, 60, 62 distribute the weight of the user through the post 26 and to the toilet bowl. The illustrated slow close dampers 48 inhibit the lid 14 and/or the seat 18 from slamming down onto the toilet bowl from a raised position.

In order to remove the toilet lid 14 and toilet seat 18 from the toilet bowl (e.g., to clean the toilet bowl), the user may provide the sufficient force on the grip portion 96 of the cap 30 to move the cap 30 into the unlocked position U (FIG. 10). Thereafter, the assembly of the lid 14, the seat 18, the post 26, and the cap 30 can slide off the base 34 in the second direction D2 to remove the lid 14 and the seat 18 from the toilet bowl.

Although the disclosure has been described in detail with reference to certain preferred embodiments, variations and modifications exist within the scope and spirit of one or more independent aspects of the disclosure as described.

Various features of the disclosure are set forth in the following claims.

What is claimed is:

1. A toilet seat hinge configured to couple a toilet seat to a toilet bowl, the toilet seat hinge comprising:
   - a base configured to be coupled to an upper surface of the toilet bowl;
   - a post defining a pivot axis about which the toilet seat can rotate, the post being slidable onto the base in a direction parallel to the upper surface of the toilet bowl to couple the post to the base; and
   - a cap pivotally coupled to the post, the cap being pivotable about the pivot axis to secure the post on the base.

2. The toilet seat hinge of claim 1, wherein the cap is pivotable between an unlocked position, in which the post is slidable onto and off of the base, and a locked position, in which the cap inhibits the post from sliding relative to the base.

3. The toilet seat hinge of claim 2, wherein the cap engages the base when in the locked position.

4. The toilet seat hinge of claim 3, wherein the cap or the base includes a recess, wherein the other of the cap or the base includes a projection, and wherein the projection engages the recess when the cap is in the locked position to secure the cap in the locked position.

5. The toilet seat hinge of claim 1, wherein the post is slidable onto the base in a direction that is perpendicular to the pivot axis.

6. The toilet seat hinge of claim 1, wherein the base is a unitary base defining a first through hole configured to receive a first fastener and a second through hole configured to receive a second fastener.

7. The toilet seat hinge of claim 6, wherein the cap covers both the first through hole and the second through hole.

8. The toilet seat hinge of claim 1, wherein the cap includes a grip portion engageable by a user to pivot the cap relative to the base.

9. A platform-style toilet seat hinge configured to couple a toilet seat to a toilet bowl, the platform-style toilet seat hinge comprising:
   - a unitary base having a first end and a second end opposite the first end, the unitary base defining a first through hole proximate the first end and a second through hole proximate the second end, the unitary base configured to be positioned on an upper surface of the toilet bowl;
   - a first fastener extending through the first through hole to couple the unitary base to the toilet bowl;
   - a second fastener extending through the second through hole to couple the unitary base to the toilet bowl; and a post including an upright portion and a frame extending from the upright portion, the upright portion defining a pivot axis about which the toilet seat can rotate, the frame being slidable onto the unitary base in a direction parallel to the upper surface of the toilet bowl to couple the post to the unitary base; and a cap pivotally coupled to the post, the cap being pivotable about the pivot axis to secure the post to the unitary base.

10. The platform-style toilet seat hinge of claim 9, wherein the frame includes two side members and a cross member extending between the two side members, wherein one of the two side members is positioned adjacent the first end of the unitary base when the post is coupled to the unitary base, and wherein another of the two side members is positioned adjacent the second end of the unitary base when the post is coupled to the unitary base.

11. The platform-style toilet seat hinge of claim 10, wherein the two side members and the cross member define a slot that receives the unitary base.

12. The platform-style toilet seat hinge of claim 11, wherein the post includes a support positioned beneath the upright portion, and wherein the unitary base contacts the support when received in the slot.

13. The platform-style toilet seat hinge of claim 9, wherein the frame is slidable onto the unitary base by a rail.

14. The platform-style toilet seat hinge of claim 9, wherein the first end of the unitary base defines a first slot and the second end of the unitary base defines a second slot, and wherein the frame includes a first rail that is received in the first slot and a second rail that is received in the second slot.

15. The platform-style toilet seat hinge of claim 9, wherein the unitary base defines a first fastener recess around the first through hole to receive a head of the first fastener, and a second fastener recess around the second through hole to receive a head of the second fastener.

16. The platform-style toilet seat hinge of claim 9, wherein the cap is movable between an unlocked position, in which the post is slidable onto and off of the unitary base, and a locked position, in which the cap inhibits the post from sliding relative to the unitary base.

17. The platform-style toilet seat hinge of claim 16, wherein the cap covers both the first fastener and the second fastener when in the locked position.

18. A method of coupling a platform-style toilet seat hinge to a toilet bowl, the platform-style toilet seat hinge including a unitary base, a post, and a cap coupled to the post, the method comprising:

positioning the unitary base on an upper surface of the toilet bowl, the unitary base having a first end and a second end opposite the first end, the unitary base defming a first through hole proximate the first end and a second through hole proximate the second end;

inserting a first fastener through the first through hole to couple the unitary base to the toilet bowl;

inserting a second fastener through the second through hole to couple the unitary base to the toilet bowl;

sliding the post onto the unitary base in a direction parallel to the upper surface of the toilet bowl, the post defining a pivot axis about which a toilet seat can pivot; and pivoting the cap relative to the post about the pivot axis to secure the post to the unitary base.

* * * * *